US005146139A

United States Patent [19]

Nilssen

[11] Patent Number: 5,146,139

[45] Date of Patent: * Sep. 8, 1992

[54] CONTROLLABLE GAS DISCHARGE LIGHTING SYSTEM

[76] Inventor: Ole K. Nilssen, Caesar Dr., Barrington, Ill. 60010

[ * ] Notice: The portion of the term of this patent subsequent to Oct. 16, 2007 has been disclaimed.

[21] Appl. No.: 481,186

[22] Filed: Feb. 20, 1990

Related U.S. Application Data

[63] Continuation-in-part of Ser. No. 317,906, Mar. 2, 1989, which is a continuation-in-part of Ser. No. 300,579, Jan. 23, 1989.

[51] Int. Cl.[5] ..... H05B 41/23

[52] U.S. Cl. ..... 315/205; 315/DIG. 4; 315/324; 315/245; 315/319

[58] Field of Search ..... 315/205, 324, 312, 294, 315/295, 299, 313, 201, DIG. 4, 313, 319

[56] References Cited

U.S. PATENT DOCUMENTS

| | | | |
|---|---|---|---|
| 3,284,667 | 11/1966 | Harris et al. | 315/DIG. 4 |
| 3,679,935 | 7/1972 | Jacques et al. | 315/201 |
| 4,284,925 | 8/1981 | Bessone et al. | 315/DIG. 4 |
| 4,345,200 | 8/1982 | Bedard et al. | 323/350 |
| 4,383,204 | 5/1983 | Roberts | 315/DIG. A |
| 4,443,740 | 4/1984 | Goralnik | 315/DIG. 4 |
| 4,570,107 | 2/1986 | Lee | 315/DIG. 4 |
| 4,743,809 | 5/1988 | Vlahos | 315/DIG. 4 |
| 4,893,064 | 1/1990 | Nilssen | 315/324 |
| 4,963,795 | 10/1990 | Nilssen | 315/219 |

FOREIGN PATENT DOCUMENTS

| | | | |
|---|---|---|---|
| 1225294 | 9/1966 | Fed. Rep. of Germany | 315/DIG. 4 |

*Primary Examiner*—Eugene R. LaRoche
*Assistant Examiner*—Tan Dinh

[57] ABSTRACT

An inverter-type fluorescent lamp ballast is powered from the power line by way of a common and either of two (or more) different power leads. When powering the ballast by way of the common and the first one of these two power leads, the power provided to the ballast's fluorescent lamp load is relatively low; when powering the ballast by way of the common and the second one of these two power leads, the power provided to the ballasts's fluorescent lamp load is relatively high. In a lighting system, the power leads from each of several such ballasts are parallel-connected and controllably powered from the power line by way of a combination of two ordinary single-pole single-throw wall switches; such that when one of the two wall switches is in its ON-position, the amount of light provided is relatively low; but when the other one of the two wall switches is in its ON-position, the amount of light provided is relatively high. Alternatively, the several ballasts can be powered from a single special wall switch with a Triac-type voltage controller, thereby providing for a continuous range of light output control.

17 Claims, 3 Drawing Sheets

CONTROLLABLE GAS DISCHARGE LIGHTING SYSTEM

RELATED APPLICATIONS

This application is a Continuation-in-Part of application Ser. No. 07/317,906 filed Mar. 2, 1989; which, in turn, is a Continuation-in-Part of application Ser. No. 07/300,579 filed Jan. 23, 1989.

BACKGROUND OF THE INVENTION

1. Field of the Invention

The present invention relates to an electronically ballasted gas discharge lighting system, particularly of a type wherein light output is controlled by way of the ballasts power input leads.

This application contains subject matter related to that of U.S. Pat. application Ser. No. 07/315,820 filed Feb. 27, 1989.

2. Description of Prior Art

Ballasts with controllable power output have been previously described, such as in U.S. Pat. No. 4,677,345 to Nilssen; wherein is described a means for controlling the power supplied to a fluorescent lamp by way of controlling the temperature of a pair of saturable current transformers used for determining the frequency in a self-oscillating half-bridge inverter loaded by way of a high-Q series-resonant LC circuit. The higher the temperature, the lower the resulting power output.

SUMMARY OF THE INVENTION

Objects of the Invention

One object of the present invention is that of providing cost-effective means for controlling the light output of a gas discharge lighting system.

Another object is that of providing an electronic ballast the power output from which may be controlled by way of its power input leads.

These as well as other objects, features and advantages of the present invention will become apparent from the following description and claims.

Brief Description

In a lighting system, plural inverter-type fluorescent lamp ballasts are powered from the power line by way of a common and either of two different power leads. When powering the ballasts by way of the common and the first one of these two power leads, the power provided to the fluorescent lamps is relatively high; when powering the ballasts by way of the second one of these two power leads, the power provided to the fluorescent lamps is relatively low.

Each inverter-type ballast comprises a self-oscillating half-bridge inverter loaded by way of a series-tuned high-Q LC circuit connected across its output. A pair of fluorescent lamps is series-connected across the tank-capacitor of the LC circuit.

Each half-bridge inverter has two bipolar switching transistors, each driven by an associated saturable current transformer that provides for a transistor ON-time dependent on the magnitude of an associated bias voltage. One of the two switching transistors has a control arrangement connected in circuit with its associated saturable transformer and is operative to control the magnitude of its associated bias voltage. As the magnitude of this bias voltage is controlled, the magnitude of the voltage across the tank-capacitor, as well as of the current available therefrom, is correspondingly controlled.

The magnitude of the bias voltage is automatically controlled such that: (a) with the lamps not-yet-ignited, the magnitude of the voltage across the tank-capacitor is maintained at a level somewhat higher than normal lamp operating voltage, except that for 10 milli-seconds once each second the magnitude is increased to a level high enough to cause lamp ignition; and (b) after the lamps have ignited, the magnitude of the lamp current is limited to an adjustably preset level.

In turn, the magnitude of the adjustably preset level is controlled as a function of the path of the input current from the power line; which path depends on whether the first or the second power lead is used for powering the ballast.

DESCRIPTION OF THE PREFERRED EMBODIMENT

Details of Construction

Figure 1:
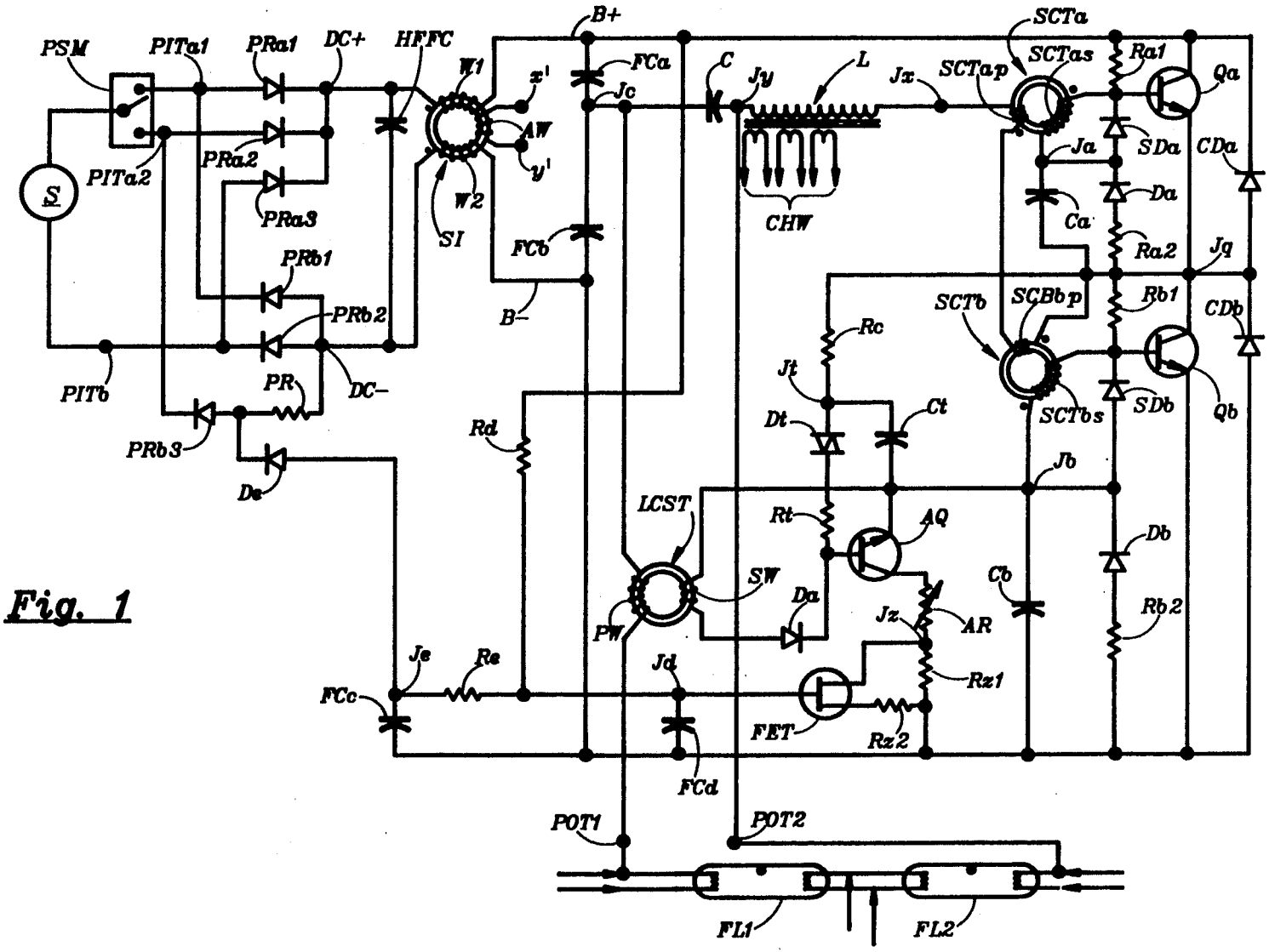
FIG. 1 represents a basic electrical circuit diagram of the preferred embodiment of the inverter-type ballast used in the lighting system.

In FIG. 1, a source S of ordinary 120Volt/60Hz power line voltage is applied to power input terminal PITb and, by way of power switch means PSM, to either of power input terminals PITal or PITa2.

Power input terminal PITal is connected with the anode of a power rectifier PRal and with the cathode of a power rectifier PRbl; power input terminal PITa2 is connected with the anode of a power rectifier PRa2 and with the cathode of a power rectifier PRb3; and power input terminal PITb is connected with the anode of a power rectifier PRa3 and with the cathode of a power rectifier PRb3. The cathodes of power rectifiers PRal, PRa2 and PRa3 are all connected with a positive terminal DC+; the anodes of power rectifiers PRbl and PRb2 are both connected with a negative terminal DC−; and the anode of power rectifier PRb3 is connected with the DC− terminal via a power resistor PR. A high-frequency filter capacitor HFFC is connected between the DC+ terminal and the DC− terminal.

A first winding Wl of an EMI suppression inductor SI is connected between the DC+terminal and a B+bus; and a second winding W2 of EMI suppression inductor SI is connected between the DC− terminal and a B− bus.

An auxiliary winding AW is wound on EMI suppression inductor SI; which auxiliary winding has output terminals x' and y'.

A filter capacitor FCa is connected between the B+ bus and a junction Jc; a filter capacitor FCb is connected between junction Jc and the B− bus. A switching transistor Qa is connected with its collector to the B+bus and with its emitter to a junction Jq; and a switching transistor Qb is connected with its collector to junction Jq and with its emitter to the B− bus. A commutating diode CDa is connected between the B+ bus and junction Jq, with its cathode connected with the B+bus; and a commutating diode CDb is similarly connected between junction Jq and the B− bus.

A saturable current transformer SCTa has a secondary winding SCTas connected between the base of transistor Qa and a junction Ja; a saturable current transformer SCTb has a secondary winding SCTbs connected between the base of transistor Qb and a junction Jb. Saturable current transformers SCTa and SCTb, respectively, have primary windings SCTap and SCTbp; which primary windings are series-connected between junction Jq and a junction Jx.

A resistor Ra1 is connected between the collector and the base of transistor Qa; a resistor Rb1 is connected between the collector and the base of transistor Qb. A capacitor Ca is connected between junction Ja and the emitter of transistor Qa; a capacitor Cb is connected between junction Jb and emitter of transistor Qb. A diode Da is connected with its cathode to junction Ja and, by way of a resistor Ra2, with its anode to the emitter of transistor Qa; a diode Db is connected with its cathode to junction Jb and with its anode to the emitter of transistor Qb. A shunt diode SDa is connected with its cathode to the base of transistor Qa and with its anode to junction Ja; a shunt diode SDb is connected with its cathode to the base of transistor Qb and with its anode to junction Jb.

An auxiliary transistor AQ is connected with its emitter to junction Jb and with its collector to a junction Jz by way of an adjustable resistor AR. A resistor Rz1 is connected between junction Jz and the B− bus. A field effect transistor FET is connected with its source to junction Jz and with its drain to the B− bus by way of a resistor Rz2. A filter capacitor FCd is connected between the B− bus and a junction Jd; the gate of transistor FET is connected with junction Jd. A resistor Rd is connected between the B+bus and junction Jd; and a resistor Re is connected between junction Jd and a junction Je. A filter capacitor FCe is connected between junction Je and the B− bus. A diode De is connected with its anode to junction Je and with its cathode to the anode of power rectifier PRb3.

A tank-inductor L is connected between junction Jx and a junction Jy; and a tank-capacitor is connected between junctions Jy and Jc. A power output terminal POT1 is connected with junction Jc by way of a primary winding PW of a lamp current sensing transformer LCST; another power output terminal POT2 is connected directly with junction Jy. First and second fluorescent lamps FL1 and FL2 are series-connected between power output terminals POT1 and POT2. Tank-inductor L has three cathode heater windings CHW; which are connected with the cathodes of fluorescent lamps FL1 and FL2.

A capacitor Ct is connected between junction Jb and a junction Jt. A Diac Dt is series-connected with a resistor Rt to form a series-combination, which series-combination is connected between junction Jt and the base of transistor AQ. A resistor Rc is connected between junctions Jq and Jt.

A secondary winding SW of transformer LCST is connected between the emitter of auxiliary transistor AQ and the anode of a diode Da, whose cathode is connected with the base of transistor AQ.

Figure 3:
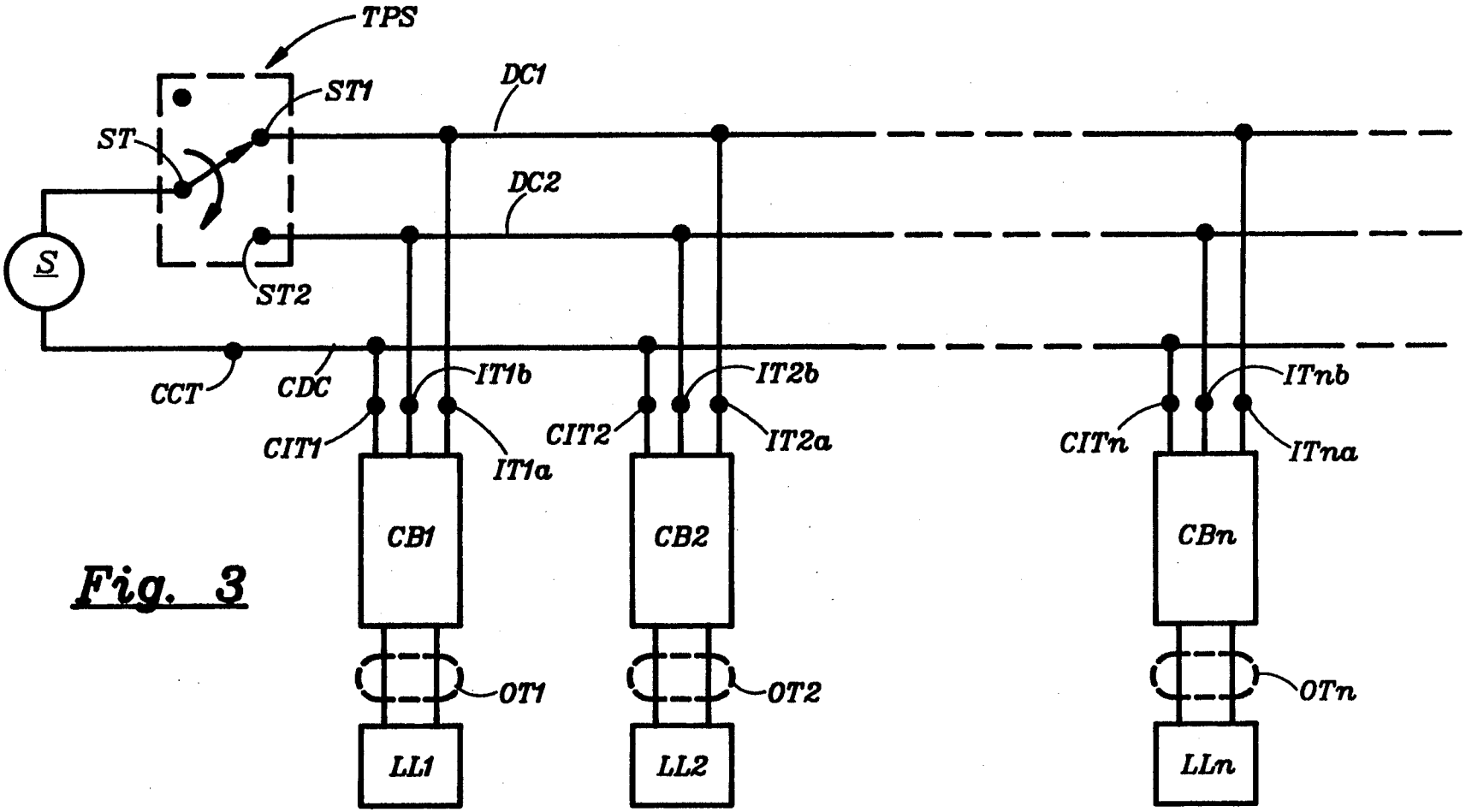
FIG. 3 represents a schematic diagram of the preferred embodiment of the overall lighting system.

In FIG. 3, power line source S is connected between a common conductor terminal CCT and a switch terminal ST of a three-position switch TPS; which three-position switch has a first switch terminal ST1 corresponding to a second switch position and a second switch terminal ST2 corresponding to a third switch position.

Common conductor terminal CCT is connected with a common distribution conductor CDC. First switch terminal ST1 is connected with a first distribution conductor DC1; and second switch terminal ST2 is connected with a second distribution conductor DC2.

A first controlled ballast CB1 has a common input terminal CIT1, a first input terminal IT1a, and a second input terminal IT1b. A first lamp load LL1 is connected with output terminals OT1 of controlled ballast CB1.

A second controlled ballast CB2 has a common input terminal CIT2, a first input terminal IT2a, and a second input terminal IT2b. A second lamp load LL2 is connected with output terminals OT2 of controlled ballast CB2.

An n'th controlled ballast CBn has a common input terminal CITn, a first input terminal ITna, and a second input terminal ITnb. An n'th lamp load LLn is connected with output terminals OTn of controlled ballast CBn.

Details of Operation

The basic operation of the half-bridge inverter of FIG. 1 is conventional and is explained in conjunction with FIG. 3 of U.S. Pat. No. 4,307,353 to Nilssen.

For a given magnitude of the DC supply voltage, due to the effect of the high-Q LC circuit, the magnitude of the current provided to the fluorescent lamp load (or to any other load presented to the output) is a sensitive function of the frequency and the waveshape of the inverter's output voltage; which output voltage is a substantially squarewave voltage of controllable frequency and with peak-to-peak magnitude about equal to that of the instantaneous magnitude of the DC voltage present between the B− bus and the B+ bus.

The frequency of the inverter's squarewave output voltage is a sensitive function of the natural resonance frequency of the high-Q LC circuit as well as of the duration of the forward conduction period (i.e., the ON-period) of the two inverter switching transistors; which duration, in turn, is a sensitive function of the saturation characteristics of saturable current transformers SCTa and SCTb as combined with the magnitude of the bias voltages present on capacitors Ca and Cb. That is, the duration of the forward conduction period (the ON-time) of each switching transistor is determined by the volt-second product sustainable by its associated saturable current transformer as well as by the magnitude of the negative bias on capacitors Ca and Cb: the higher the volt-second product available before saturation, the longer the ON-time; the higher the negative bias on the Ca/Cb capacitors, the shorter the ON-time.

In the circuit arrangement of FIG. 1, the magnitude of the negative voltage on capacitors Ca and Cb is determined by the magnitude of the current provided to the bases of transistors Qa and Qb, less any current drained away through resistors R2a and Rb2/AR/Rz1/Rz2, respectively. (Of course, a small amount of current is also drained away from bias capacitors Ca and Cb by resistors Ra1 and Rb1, respectively. However, this amount of charge leakage is in most situations negligible. Resistors Ra1 and Rb1 are principally used for getting the inverter to initiate oscillation.)

The magnitude of the base current provided to each transistor is directly proportional to the magnitude of the current flowing through the primary windings of saturable current transformers SCTa and SCTb.

Assuming transistors AQ and FET to be conducting, for given values of resistors R2a and Rb2/AR/Rzl/Rz2: the higher the magnitude of the inverter's output current, the higher the magnitude of the negative voltage on capacitors Ca and Cb.

Thus, for given values of resistors Ra2 and Rb2/AR/Rzl/Rz2, the circuit of FIG. 1 provides for a high degree of regulation of the magnitude of the inverter's output current.

By selecting a suitable resistance value for resistor Ra2, and assuming transistor AQ to be conducting, the magnitude of the inverter's output current may be adjusted by adjusting the resistance value of AR: a relatively low resistance value leads to an inverter output current of relatively high magnitude; a relatively high resistance value leads to an inverter output current of relatively low magnitude.

The higher the magnitude of the negative voltage on each bias capacitor, the higher the magnitude of the voltage that has to be provided from the secondary winding of each saturable current transformer; which, in turn, leads to a correspondingly shorter period before saturation is reached. Thus, as the magnitude of the negative bias on each bias capacitor is increased, the duration of each transistor's forward conduction period (ON-time) is decreased; which, in turn, leads to a reduction in the magnitude of the inverter's output current in comparison with what it otherwise would have been.

Whereas the base current provided to each transistor has to flow from its associated bias capacitor, the reverse or reset current provided from each of the saturable current transformer's secondary windings does not flow from the bias capacitor, but rather flows in a separate path through the reverse shunt diode (SDa or SDb) shunting the secondary winding of each saturable current transformer.

More particularly, the circuit and control arrangement of FIG. 1 operates as follows.

As power is applied at power input terminals PITb and PITal (or PITa2), the inverter starts to oscillate at a frequency near the natural self-resonance frequency of the LC circuit. The resulting inverter output current results in a positive feedback current provided to each base; and this feedback current, in turn, causes a negative bias to build up on each of bias capacitors Ca/Cb. As the magnitude of the negative bias voltage increases, the inverter's oscillation frequency increases as well. As a result, the magnitude of the inverter output current will stabilize at a some level determined by the effective resistance values of resistors Ra2 and Rb2/AR/Rzl/Rz2.

With the fluorescent lamps non-connected or otherwise non-functional, transistor AQ is effectively non-conducting; and under this non-loaded condition the magnitude of the high-frequency (30 kHz or so) inverter current stabilizes at a level determined by the resistance values of resistors Ra2 and Rb2.

With the fluorescent lamps connected and fully operating (i.e., fully loading the LC circuit), transistor AQ is conducting by virtue of the current provided to its base by way of lamp current sensing transformer LCST; and transistor FET is conducting as well by virtue of the positive bias voltage provided to its gate by way of resistors Rd and Re. Under this condition, the effect of resistor Rb2 may be neglected because its resistance is much higher than that effectively represented by resistors AR/Rzl/Rz2; and—provided the power line voltage from source S is indeed connected between power input terminals PITal and PITb—the magnitude of the high-frequency inverter output current stabilizes at a level effectively determined by the resistance values of resistors Ra2 and AR as series-connected with the parallel-combination of resistors Rzl and Rz2.

With transistor FET non-conducting, which will occur whenever the power line voltage is connected between power input terminals PITa2 and PITb, the magnitude of the high-frequency inverter output current will effectively be determined by the resistance values of Ra2 and AR as series-connected with resistor Rzl by itself.

Thus, with the power line connected between power input terminals PITa2 and PITb, the high-frequency inverter output current will be limited to a magnitude lower than that resulting when the power line is connected with power input terminals PITal and PITb.

In terms of further explanations: whenever the power line voltage is connected between power input terminals PITal and POTb, no current flows through resistor PR; and, as a result, the DC voltage developing at junction Jd will be of adequate (positive) magnitude to cause transistor FET to become conductive; whenever the power line voltage is connected between power input terminals PITa2 and PITb, current will flow through resistor PR; which current will result in a 60 Hz pulsed DC voltage across resistor PR. The polarity of this voltage, as referenced to the B− bus, will be negative; and, as a result, the effective magnitude of the DC voltage provided at junction Jd will decrease enough to cause transistor FET to stop conducting.

Thus, with the power line voltage applied between terminals PITal and PITb, transistor FET conducts and the magnitude of the inverter's output current is relatively large; with the power line voltage applied between terminals PITa2 and PITb, transistor FET does not conduct and the magnitude of the inverter's output current is relatively small.

More particularly, the resistance value of resistor Ra2 is selected such that the ON-time of transistor Qa corresponds to nearly a 50% duty-cycle. Then, with transistor AQ non-conducting, the resistance value of Rb2 is selected such as to result in an inverter output current of magnitude such as to provide for a high-frequency voltage across the tank-capacitor that is equal (or slightly larger) in magnitude than that of the voltage across the fluorescent lamps under normal lamp operation. Next, with adjustable resistor AR set at minimum value, and with the power line connected between terminals PITa2 and PITb, the resistance value of resistor CLR1 is selected such as to result in a lamp operating current of a magnitude substantially below that of the maximum desired lamp operating current. Next, again with adjustable resistor AR set at minimum value, but with the power line connected between terminals PITal and PITb, the value of resistor CLR2 is selected such as to provide lamp operating current of the maximum desired magnitude.

Under the condition of normal lamp loading of the LC circuit, the RMS magnitude of the voltage provided to the lamp cathodes is so selected as to provide for proper cathode heating. Thus, as the circuit is initially powered, even though the lamps have not yet ignited, the cathodes are provided with a heating voltage of RMS magnitude approximately appropriate for proper cathode heating; yet, the magnitude of the high-frequency voltage then provided across the lamps is too low to cause lamp ignition. However, by action of the trigger arrangement consisting of elements Rc, Ct, Dt and Rt, after about one second (and once each second thereafter), a current pulse of about 10 milli-second duration will be provided to the base of transistor AQ, thereby making this transistor conduct for a period of about 10 milli-seconds. During this 10 milli-second period, the magnitude of the high-frequency voltage across the tank-capacitor will increase substantially, and the lamps will ignite.

During the 10 milli-second period, the magnitude of the cathode heating voltages also increases substantially, thereby aiding in lamp ignition. However, on an integrated RMS basis, this brief period of increased-magnitude cathode heating voltage is of little consequence.

As soon as the lamps ignite, lamp current will start to flow; and, by way of transformer LCST, transistor AQ will now become fully conducting on at least a 50% duty-cycle basis; which implies that the 10 milli-second pulses that will continue to be provided every second or so will be of little consequence.

If the lamps were to be disconnected, however, the repeatedly provided 10 milli-second pulses will assure that affirmative lamp ignition will occur as soon as fully functional lamps are re-connected.

As long as transistor AQ is kept conductive, the fluorescent lamps will be powered in a normal manner; and the relative magnitude of the lamp current then flowing will depend on the particular setting of adjustable resistor AR. The absolute maximum magnitude of the lamp current will depend on which of terminals PITal and PITa2 the power line is connected to.

In case of a ground-fault condition—which typically might occur if fluorescent lamp FL2 were to be connected at its one end with power output terminal POT2 while a ground-connected person held onto the lamp's terminals at its other end—high-frequency current would flow out from the ballast at terminal POT2, through the lamp and the person to ground, and then eventually back to the ballast by way of one or both of the power input terminals (PITl/PIT2. However, since necessarily this condition would require that lamp current stop flowing through lamp current sensing transformer LCST, transistor AQ would cease to conduct and the magnitude of any current then flowing from output terminal POT2 would be limited to a level that is substantially lower than that of full-power lamp current. In particular, the magnitude of the resulting ground-fault current will only be on the order of 30 milli-Ampere; which is a level that—at a frequency of 30 kHz or so—is considered by authoritative entities, such as Underwriters Laboratories, Inc. of Northbrook, Illinois, as being substantially non-hazardous.

Figure 2:
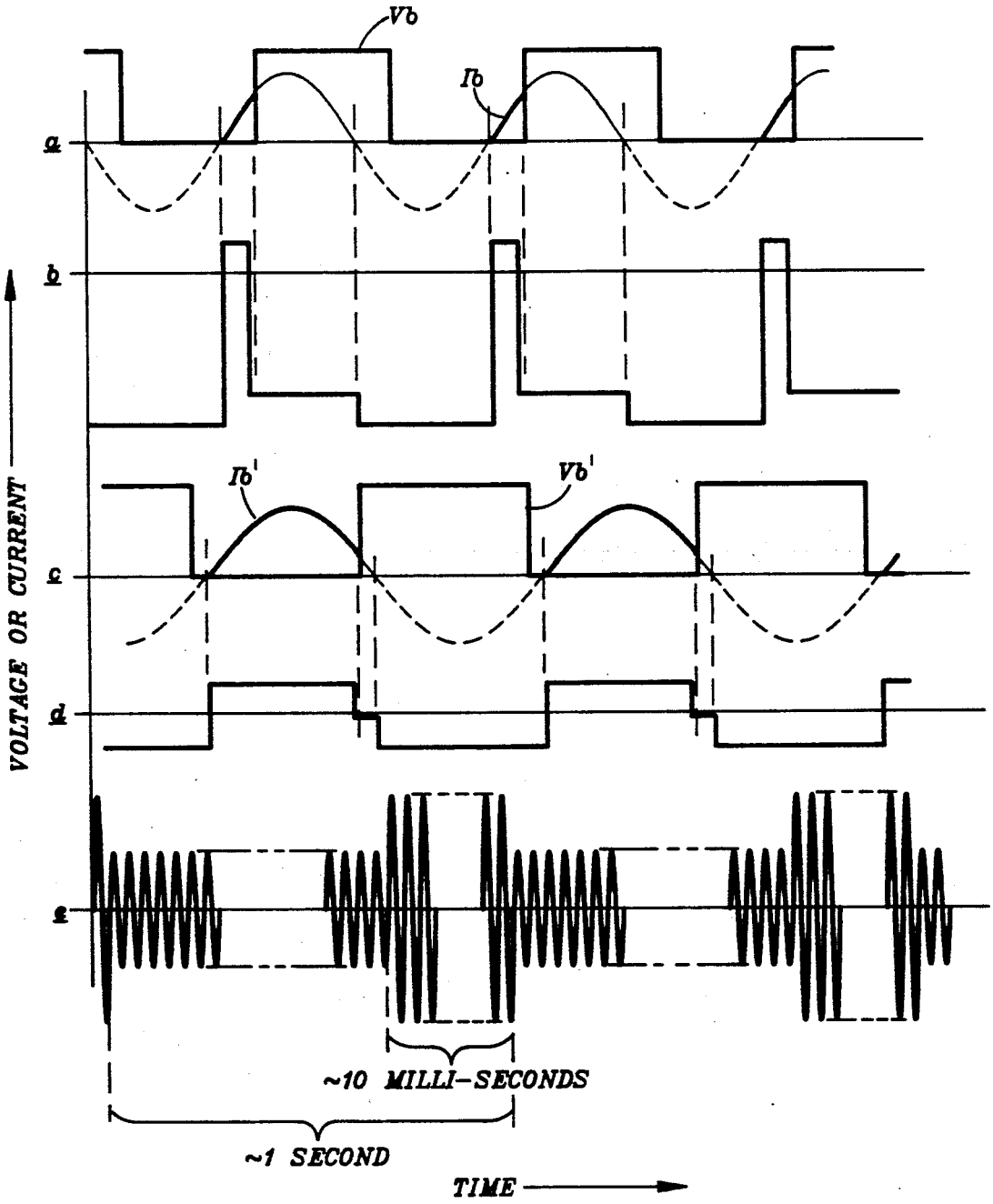
FIG. 2 illustrates waveshapes of various high frequency voltages and currents present within the circuit during different modes of operation.

FIG. 2 depicts various voltage and current waveforms associated with the circuit of FIG. 1.

For a situation with no loading presented to the high-Q LC circuit—that is, with the lamps disconnected, or before the lamps have ignitied—FIG. 2*a* shows the collector-to-emitter voltage Vb of transistor Qb and the corresponding inverter output current Ib. The part of Ib actually flowing through transistor Qb in the forward direction is shown in heavy solid line, the part of Ib flowing through commutating diode CDa is showed in light solid line, and the part of Ib flowing through either Qa or CDb is shown in light dashed line.

FIG. 2*b* shows the base-emitter voltage of transistor Qb as it corresponds to the waveforms of FIG. 2*a*.

For a situation where the LC circuit is substantially fully loaded by the two fluorescent lamps, FIG. 2*c* shows the collector-to-emitter voltage Vb' of transistor Qb and the corresponding inverter output current Ib'. The part of Ib' actually flowing through transistor Qb in the forward direction is shown in heavy solid line, the part of Ib' flowing through commutating diode CDa is showed in light solid line, and the part of Ib' flowing through either Qa or CDb is shown in light dashed line.

FIG. 2*d* shows the base-emitter voltage of transistor Qb as it corresponds to the waveforms of FIG. 2*c*.

FIG. 2*e* shows the waveshape of the high-frequency voltage present across the tank-capacitor under the condition of an unloaded LC circuit: a continuous substantially sinusoidal voltage of a relatively low magnitude, interrupted once each second with a 10 milli-second long burst of relatively high-magnitude substantially sinusoidal voltage.

In light of the above-explained operation of the ballast arrangement of FIG. 1, the operation of the lighting system schematically illustrated by FIG. 3 may be explained as follows.

With three-position switch TPS in the position shown, each of the plural controllable ballasts (ex: CBl) is powered by way of its common input terminal (ex: CITl) and its first input terminal (ex: ITla); which, respectively, correspond to power input terminals PITb and PITal of the arrangement of FIG. 1.

With three-position switch TPS in such a position as to connect switch terminal ST with switch terminal ST2, each of the plural controllable ballasts (ex: CBl) is powered by way of its common input terminal (ex: CITl) and its second input terminal (ex: ITlb); which, respectively, correspond to power input terminals PITb and PITa2 of the arrangement of FIG. 1.

Thus, with switch TPS in the former position, the light output from the lighting system of FIG. 3 is at a maximum level; whereas with switch TPS in the latter position, the light output from the lighting system is at a reduced level.

Additional Comments a) Detailed information relative to a fluorescent lamp ballast wherein the fluorescent lamp is powered by way of a series-excited parallel-loaded L-C resonant circuit is provided in U.S. Pat. No. 4,554,487 to Nilssen.

b ) The instantaneous peak-to-peak magnitude of the squarewave output voltage provided by the half-bridge inverter between junctions Jq and Jc is substantially equal to the instantaneous magnitude of the DC supply voltage.

c) Saturable current transformers SCTa and SCTb require only a miniscule voltage across their primary windings. Hence, the magnitude of the voltage-drop between junctions Jq & Jx is substantially negligible, and the inverter's full output voltage is therefore effectively provided across the LC circuit, which consists of tank-capacitor C and tank- inductor L.

d) In FIG. 2, the inverter frequency associated with the waveforms of FIGS. 2*a* and 2*b* is substantially higher than that associated with FIGS. 2*c* and 2*d*.

Also, current Ib is nearly 180 degrees out of phase with the fundamental frequency component of voltage Vb, while current Ib' is almost in phase with voltage Vb'.

e) In the situation associated with the waveform of FIG. 2*b*, the magnitude of the voltage "seen" by the secondary winding of saturable current transformer SCTb is about five times as high as that "seen" by the same secondary winding in the situation associated with FIG. 2*d*.

Correspondingly, the duration of the transistor ON-time in the situation associated with FIG. 2*d* is about five times longer than the transistor ON-time in the situation associated with the waveform of FIG. 2*b*.

f) As may be noticed in FIG. 2*a*, transistor Qb ceases to conduct in its forward direction while a substantial amount of current is still flowing from the inverter's output. After transistor Qb has ceased to conduct, the inverter's output current will continue to flow until the energy in the tank inductor has dissipated itself. However, the output current will continue its flow through commutating diode CDa, thereby discharging its energy into the DC power supply.

g) Forward conduction of a transistor is defined as current flowing, with the aid of forward base drive current, directly between the collector and the emitter; which, in case of transistor Qb for, instance, means that forward current is defined as positive current flowing from its collector to its emitter while drive current is being provided to its base.

A transistor's ON-time is defined as the period during which it conducts current in the forward direction.

h) In FIG. 2 it is noted that the fundamental frequency of the waveforms depicted in FIGS. 2*c* and 2*d* is lower by a certain factor as compared with the frequency associated with the waveforms of FIGS. 2*a* and 2*b*; yet the indicated duration of transistor ON-time associated with the waveforms of FIGS. 2*a* and 2*b* is shorter by a much larger factor as compared with the indicated duration of transistor ON-time associated with the waveforms of FIGS. 2*c* and 2*d*.

In fact, when the transistor ON-time is shortened by a given proportion, the fundamental frequency of the inverter's output voltage increases by a much smaller proportion. In instant case, with the Qb transistor's ON-time shortened by a factor of about five, the inverter frequency increased only by a factor of about 1.3: from about 30 kHz to about 40 kHz.

i) The time constant associated with each bias capacitor and its associated leakage resistance means is normally longer than a complete cycle of the high frequency inverter output voltage, and it is typically on the order of several such complete cycles.

For instance, for a situation where the power line input voltage is 120Volt/60Hz, the frequency of the inverter output voltage/current is on the order of 30 kHz, and the total inverter power output falls in the range between 10 and 100 Watt, the capacitance values of bias capacitors Ca and Cb might reasonably be in the range from one to ten micro-Farad, the resistance value of leakage resistor Ra2 might reasonably be in the range between 10 and 100 Ohm, the resistance value of adjustable resistor AR Ohm, and the resistance values of resistors Rzl and Rz2 might each reasonably be in the range between 5 to 50 Ohm.

Thus, in general, the magnitude of the bias voltage on the bias capacitors is responsive to the average magnitude of the inverter's output current—normally as averaged over at least a full cycle of this output current.

j) With power input terminals PITal/PITa2 and PITb connected with an ordinary electric utility power line, all electrical parts of the circuit arrangement of FIG. 1 are effectively connected with earth ground by way of those power input terminals.

k) Although not expressly shown in FIG. 1, it is emphasized that fluorescent lamps FLl and FL2 are connected with terminals POTl and POT2 by way of lamp socket means of a type that has electrical terminal means that are non-accessible to a person's fingers or the like. However, the terminal means of the fluorescent lamps themselves are of a type that does permit a person to touch them directly, provided they are not inserted into their sockets.

Thus, in a situation where the circuit arrangement of FIG. 1 is used as a fluorescent lamp ballasting means, and under otherwise ordinary circumstances, the only way that a person is able to get exposed to a ground-fault current from the circuit arrangement of FIG. 1 is by holding on to the terminals at one end of a fluorescent lamp while inserting the other end into a lamp socket connected with the POT2 or the "hot" terminal.

l) In the circuit arrangement of FIG. 1 there are two distinctly different kinds of magnitude-limiting of the inverter's output current. One is the ordinary kind associated with the natural characteristics of a series-excited parallel-loaded resonant LC circuit; another is due to the action of the control circuit associated with auxiliary transistor AQ.

m) Due to basic factors related to magnetic hysteresis and leakage inductance, lamp current sensing transformer LCST requires the lamp current to have a certain minimum magnitude before producing an output signal of magnitude adequate to cause auxiliary transistor AQ to become conductive. Hence, there is a minimum threshold level automatically built into the control means used for sensing lamp current. This threshold level may readily be changed, for instance by changing the number of turns on primary winding PW, or by placing a shunting impedance across secondary winding SW.

n) In the control circuit related to and including auxiliary transistor AQ, there are to main control effects: (i) one associated with the fact that the magnitude of the bias voltage on capacitor Cb tends to vary around an average level as a function of the average absolute magnitude of the inverter's output current, and (ii) one associated with the fact that the average level around which the bias voltage varies may itself be varied, such as by varying the magnitude of the base current provided to auxiliary transistor AQ.

o) Without any substantial loading on the LC circuit, its Q-factor is quite high, and—absent proper control measures —the magnitude of the voltage developing across the tank-capacitor tends to become destructively high.

A large-magnitude voltage across the tank-capacitor must by necessity be associated with an inverter output current of correspondingly large magnitude. However, a large-magnitude inverter output current will cause a correspondingly high-magnitude negative bias on both bias capacitors, but—absent lamp current of magnitude sufficient to place transistor AQ into conduction—particularly on bias capacitor Cb' the two bias capacitors have to provide a positive current of magnitude proportional to the average absolute magnitude of the inverter's output current; which means that the magnitude of the negative bias voltage will have to increase with increasing magnitude of the inverter output current.

It is this negative feedback feature, which relates to negative feedback of the rectified average magnitude of the inverter's output current (i.e., DC negative feedback), that provides for stable controllable operation of a self-oscillating inverter whose output is connected across an unloaded high-Q series-connected LC circuit.

p) In fact, the circuit arrangement of FIG. 1 may be defined as an inverter that is loaded by way of a high-Q tuned LC circuit and arranged to self-oscillate by way of positive AC feedback derived from the inverter's instantaneous output current (and/or voltage) while at the same time arranged to provide for controllable-magnitude output current (and/or voltage) by way of negative DC feedback derived from the average absolute magnitude of the inverter's output current (and/or voltage).

q) So as to fully reset the saturable cores each cycle, diodes SDa and SDb should each have a relatively high-magnitude forward voltage drop, such as might be obtained by using two or three ordinary diodes in series. However, instead of using special diodes with high-magnitude forward voltage drops, it is acceptable to use ordinary diodes with added series-resistors, thereby effectively to increase their forward voltage drops.

r) With adjustable resistor AR set to zero and with the power line connected with power input terminal PITal, the magnitude of the relatively high-magnitude high-frequency voltage of FIG. 2e is established by suitable choice of the resistance value of resistor Rzl as parallel-connected with resistor Rz2.

s) Some of the values associated with operating the ballast with the kind of waveform indicated by FIG. 2e are as follows: (i) relaxed specifications for the tank-inductor; (ii) relaxed specifications for the tank-capacitor; (iii reduced glow current prior to lamp ignition, thereby providing increased lamp life; (iv) improved lamp starting; (v) reduced idling power; and (vi) cost-effective compliance with U.L. specifications related to ground-fault current.

t) The RMS magnitude of the cathode heating voltage, which voltage is provided to each of the lamps' thermionic cathodes by way of cathode heating windings CHW, is such as to provide for proper cathode heating during the period before the lamps ignite, as well as on a continuous basis thereafter.

During the brief pulses provided by way of elements Rc, Ct, Dt and Rt, the RMS magnitude of the cathode heating voltage is increased to about twice normal value. However, since the duration of each of these pulses is so brief (about 10 milliseconds) compared with the duration of each of the periods between such pulses (about 1000 milli-seconds), the net effect on the temperature of the cathodes is negligible. However, with respect to lamp ignition, the effect is substantial and beneficial. The briefly elevated RMS magnitude of the cathode voltage gives rise to ionization of the lamp gas along the cathodes' surfaces, thereby greatly facilitating the ignition of the main gas columns of the lamps.

u) With the series-connected LC circuit unloaded, the RMS magnitude of the high-frequency output voltage, as provided at output terminals POTl/POT2, is determined by the value of resistor Rb2, except for the brief one milli-second intervals (see FIG. 2e). During these one milli-second intervals, the RMS magnitude of the high-frequency output voltage is determined by the combined resistance values of AR, Rzl and Rz2.

v) By providing for additional sets of elements corresponding to PRa2, PRb3, PR, Dc, FCe, Re, Rd, FCd, FET and Rz2, correspondingly additional levels of ballast output power may be provided for.

In particular, a ballast may have one common power input terminal (PITb) and any number of separate individual power input terminals PITal, PITa2, PITa3—PITan, with each separate individual power input terminal corresponding to a given ballast output power.

w) In the arrangement of FIG. 1, the frequency of the current provided to the fluorescent lamps changes with the amount of power provided to the lamps: the higher the amount of power, the lower the frequency. This effect is directly related to the situation illustrated in FIG. 2 the higher the negative bias on bias capacitor Cb (see FIG. 2b versus FIG. 2d), the higher the frequency, and the less the power provided to the load.

Thus, when power line voltage is switched from terminal PITal to terminal PITa2, the inverter frequency increases.

x) In some situations, to eliminate the possibility of problems associated with leakage current through Diac Dt and/or with transients picked up by lamp current sensing transformer LCST, it may be advantageous to place a resistor in parallel with the base-emitter junction of transistor AQ.

y) In the arrangement of FIG. 1, the power line voltage from S may be applied either across a first pair or a second pair of input terminals: the first pair being terminals PITal and PITb; the second pair being terminals PITa2 and PITb.

It is emphasized, however, that in some situations it may be better to arrange from the power line voltage to be applied either: (i) across the second pair of power input terminals; or (ii) across both the first and the second pair of power input terminals. In this latter case, control of light output may be accomplished by way of a simple single-pole ON/OFF switch.

z) In the power input circuit arrangement of FIG. 1, it would be straight-forwardly possible to place a low-value resistor in series with rectifier PRbl, in a manner similar to the resistor (PR) connected in series with rectifier PRb2. Then, with a diode connected between the anode of rectifer PRbl and the anode of diode De, an additional degree of control flexibility would be attained; which additional degree of control flexibility would provide for three levels of light output control: (i) a maximum level in which the power line is connected between terminal PITb and the combination of terminals PTal and PIT2a; (ii) a first intermediary level in which the power line is connected between terminal PITb and terminal PTal; and (iii) a second intermediary level in which the power line is connected between terminal PITb and terminal PITa2.

aa) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A lighting system comprising:

a source providing a power line voltage at a pair of power line terminals;

a set of power distribution conductors, including: (i) a common power distribution conductor; (ii) a first power distribution conductor; and (iii) a second power distribution conductor;

plural ballast-lighting means positioned at spaced-apart locations along the power distribution conductors; each ballast-lighting means having: (i) a set of power output terminals connected with a gas discharge lamp means and operative to supply a lamp current thereto, the frequency of the lamp current being substantially higher than the frequency of the power line voltage; (ii) a common power input terminal connected with the common power distribution conductor; (ii) a first power input terminal connected with the first distribution conductor; and (iv) a second power input terminal connected with the second power distribution conductor; and control means connected in circuit between the power line terminals and the power distribution conductors; the control means being operative to control the amount of light being provided by the gas discharge lamp means;

the lighting system being operative as stated without requiring more than three power distribution conductors.

2. The system of claim 1 wherein the control means is operative to exist in plural modes; one of the plural modes being characterized by the power line voltage being provided between the common and the first power distribution conductor.

3. The system of claim 2 wherein another one of the plural modes is characterized by the power line voltage being provided between he common and the second power distribution conductor.

4. The system of claim 1 wherein the gas discharge lamp means is powered with a lamp current of frequency substantially higher than that of the power line voltage.

5. The system of claim 1 wherein the control means includes an ordinary wall switch.

6. The system of claim 1 wherein the control means includes a switch means having at least three positions.

7. The system of claim 1 wherein at least one of the plural ballast-lighting means provides a useful amount of light output whether the power line voltage is applied between: (i) the common and the first power input terminal; or (ii) the common and the second power input terminal.

8. An arrangement comprising:

a source providing AC power line voltage between a first and a second power line terminal;

power distribution conductors including a common power distribution conductor, a first power distribution conductor, and a second power distribution conductor.

plural lighting means disposed at spaced-apart points along the power distribution conductors; each lighting means having power input conductors, including a common power input conductor connected with the common power distribution conductor, a first power input conductor connected with the first power distribution conductor, and a second power input conductor connected with the second power distribution conductor; at least one of the plural lighting means including an inverter-type ballast means connected with the power input conductors and operative to provide, to a gas discharge lamp, a voltage of frequency substantially higher than that of the AC power line voltage; and connect means operative: (i) to connect the first power line terminal with the common power distribution conductor, and (ii) selectively, to connect the second power line terminal to either the first or the second power distribution conductor.

9. An arrangement comprising:

distribution conductors including a common conductor, a first conductor, and a second conductor; a power line voltage being provided either between the common conductor and the first conductor, or between the common conductor and the second conductor; and plural lighting means disposed at spaced-apart locations along the distribution conductors; each lighting means having a common terminal, a first terminal, and a second terminal; which terminals are connected, respectively, with the common conductor, the first conductor, and the second conductor; at least one of the plural lighting means including an inverter-type ballast means connected with said terminals and operative to provide, to a gas discharge lamp, a current of frequency substantially higher than that of the power line voltage; the lighting means being operative to provide: (i) a certain level of light when the power line voltage is provided between the common conductor and the first conductor, and (ii) a different level of light when the power line voltage is provided between the common conductor and the second conductor.

10. The arrangement of claim 9 wherein each lighting means is characterized by comprising frequency-conversion means.

11. The arrangement of claim 9 wherein each lighting means is characterized by comprising a gas discharge lamp.

12. The arrangement of claim 11 wherein the gas discharge lamp is powered with a lamp current of frequency substantially higher than the fundamental frequency of the power line voltage.

13. The arrangement of claim 9 wherein the power line voltage is characterized as being an AC voltage.

14. The arrangement of claim 9 wherein the power line voltage is provided to the distribution conductors by way of a switch means connected between the distribution conductors and a source of power line voltage.

15. In a lighting system having plural lighting fixtures, the improvement comprising:

a power line providing a power line voltage at a pair of power line terminals;

power distribution conductors including a first, a second and a third power distribution conductor;

a switch means connected in circuit between the power line terminals and the power distribution conductors; the switch means being operative to controllably permit the power line voltage to be applied either between the first and the second power distribution conductor or between the first and the third power distribution conductor;

plural lighting fixtures located at spaced-apart points along the power conductors; each lighting fixture having power input terminals, including a first, a second and third power input terminal; the first, second and third power input terminals being respectively connected with the first, second and third power distribution conductors; each lighting fixture: (i) having a gas discharge lamp connected with the power input terminals by way of an inverter-type ballast; and (ii) being functional to provide a certain level of light output whenever the power line voltage is provided between the first and second power input terminals and a substantially higher level of light output whenever the power line voltage is provided between the first and third power input terminals.

16. The improvement of claim 15 wherein each lighting fixture includes a gas discharge lamp having a lamp current of frequency substantially higher than that of the power line voltage.

17. In a lighting system having plural lighting fixtures, the improvement comprising:

a power line providing a power line voltage at a pair of power line terminals;

power distribution conductors including a first a second and a third power distribution conductor;

switch means connected in circuit between the power line terminals and the power distribution conductors; the switch means being operative to controllably permit the power line voltage to be applied either between the first and the second power distribution conductor or between the first and the third power distribution conductor;

plural lighting fixtures located at spaced-apart points along the power conductors; at least one of these lighting fixtures having power input terminals, including a first, a second and a third power input terminal; the first, second and third power input terminals being respectively connected with the first, second and third power distribution conductors; said at least one of these lighting fixtures: (i) including an inverter-type ballast connected with the power input terminals as well as a gas discharge lamp, with the gas discharge lamp being connected with the ballast; and (ii) being functional to provide a relatively low level of light output whenever the power line voltage is provided between the first and second power input terminals and a relatively high level of light output whenever the power line voltage is provided between the first and third power input terminals.

* * * * *